US009914067B2

(12) United States Patent
Sufer et al.

(10) Patent No.: US 9,914,067 B2
(45) Date of Patent: Mar. 13, 2018

(54) FLEXIBLE BUILDING SEGMENT

(71) Applicant: WOWWEE GROUP LTD., Hong Kong (HK)

(72) Inventors: Davin Sufer, Montreal (CA); Ellyn Le Masson, Montreal (CA); Anthony Lemire, Montreal (CA)

(73) Assignee: WOWWEE GROUP LTD., Hong Kong (HK)

( * ) Notice: Subject to any disclaimer, the term of this patent is extended or adjusted under 35 U.S.C. 154(b) by 0 days.

(21) Appl. No.: 15/605,801

(22) Filed: May 25, 2017

(65) Prior Publication Data

US 2017/0340979 A1 Nov. 30, 2017

Related U.S. Application Data

(60) Provisional application No. 62/341,642, filed on May 26, 2016.

(51) Int. Cl.
*A63H 33/04* (2006.01)
*A63H 33/08* (2006.01)

(52) U.S. Cl.
CPC ..... *A63H 33/046* (2013.01); *A63H 33/084* (2013.01)

(58) Field of Classification Search
CPC ..... A63H 33/046; A63H 33/084; A63H 33/04
USPC ... 446/92, 97, 107, 108, 109, 116, 119, 124, 446/125
See application file for complete search history.

(56) References Cited

U.S. PATENT DOCUMENTS

| | | | | |
|---|---|---|---|---|
| 7,364,487 | B2 * | 4/2008 | Evans | A63H 33/008 446/108 |
| 7,371,146 | B2 * | 5/2008 | Scarborough | A63H 33/062 446/108 |
| 7,413,493 | B2 | 8/2008 | Toht et al. | |
| 8,197,297 | B2 * | 6/2012 | Shimizu | A63H 33/12 446/114 |
| 2010/0120322 | A1 * | 5/2010 | Vicentelli | A63H 33/046 446/92 |

* cited by examiner

*Primary Examiner* — Vishu Mendiratta
(74) *Attorney, Agent, or Firm* — Merchant & Gould P.C.

(57) ABSTRACT

A flexible building segment includes a first outer-section, a second outer-section, a central-section, a first ribs-section and a second ribs-section. The first outer-section includes a first magnet embedded therein. The second outer-section includes a second magnet embedded therein. The central-section includes a central magnet embedded therein and at least two central attachment slots at opposite sides thereof. The first ribs-section includes a first flexible portion and respective ribs. The first flexible portion couples the central-section with the first outer-section. The ribs, respective of the first ribs-section, are attached to the first flexible portion and parallel to each other. The second ribs-section includes a second flexible portion and respective ribs. The first flexible portion couples the central-section with the second outer-section. The ribs, respective of the second ribs-section, are attached to the second flexible portion and parallel to each other.

11 Claims, 10 Drawing Sheets

FLEXIBLE BUILDING SEGMENT

This application claims benefit of U.S. Provisional Patent Application No. 62/341,642, filed May 26, 2016, which application is incorporated herein by reference. To the extent appropriate, a claim of priority is made to the above disclosed application.

FIELD OF THE INVENTION

The disclosed technique relates to building segments, in general, and to flexible building segments, in particular.

BACKGROUND OF THE INVENTION

Building blocks are known in the art. Specifically, building blocks which include magnets which enable various building blocks to be magnetically coupled with each other are also known in the art.

U.S. Pat. No. 7,413,493 to Toht et al entitled "Magnetic building block" a children's toy which includes a block, an internal support, a casing, a magnet and a cap. The block includes a plurality of walls defining a substantially hollow interior where at least one of the walls including an opening. The internal support extends from at least one of the walls, into the hollow interior of the block. The casing is mounted within the hollow interior of the block. The internal support engages the casing to support the casing within the hollow interior. The first magnet is housed within the casing and freely moves within the casing. The cap is adapted enclose the casing.

SUMMARY OF THE INVENTION

It is an object of the disclosed technique to provide a novel a flexible building segment. In accordance with the disclosed technique, there is thus provided a flexible building segment which includes a first outer section, a second outer section, a central section, a first ribs section and a second ribs section. The first outer section includes a first magnet embedded therein. The second outer section includes a second magnet embedded therein. The central section includes a central magnet embedded therein and at least two central attachment slots at opposite sides thereof. The first ribs section includes a first flexible portion and respective ribs. The first flexible portion couples the central section with the first outer section. The ribs, respective of the first ribs section, are attached to the first flexible portion and parallel to each other. The second ribs section includes a second flexible portion and respective ribs. The first flexible portion couples the central section with the second outer section. The ribs, respective of the second ribs section, are attached to the second flexible portion and parallel to each other.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

The disclosed technique overcomes the disadvantages of the prior art by providing a flexible building segment. Different sections of a flexible building segment according to the disclosed technique may be coupled with each other and to other flexible building segments.

Figure 1B:
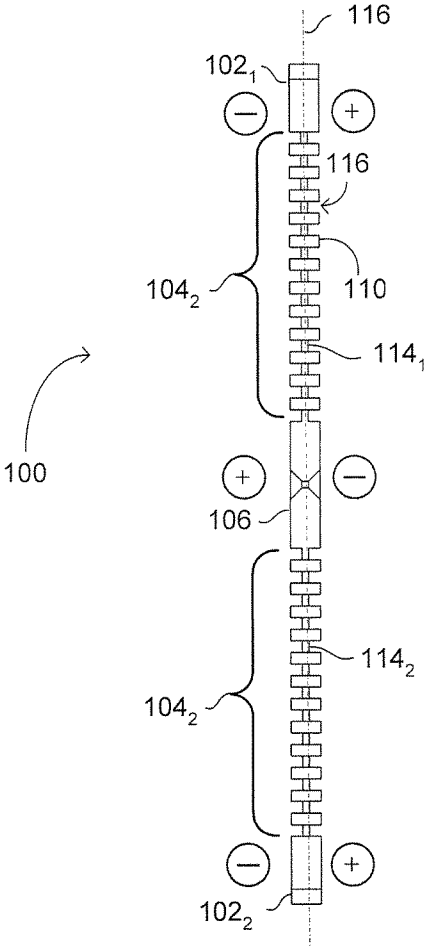
FIGS. 1A and 1B is a schematic illustration of a flexible building segment, constructed and operative in accordance with an embodiment of the disclosed technique.
Figure 1A:
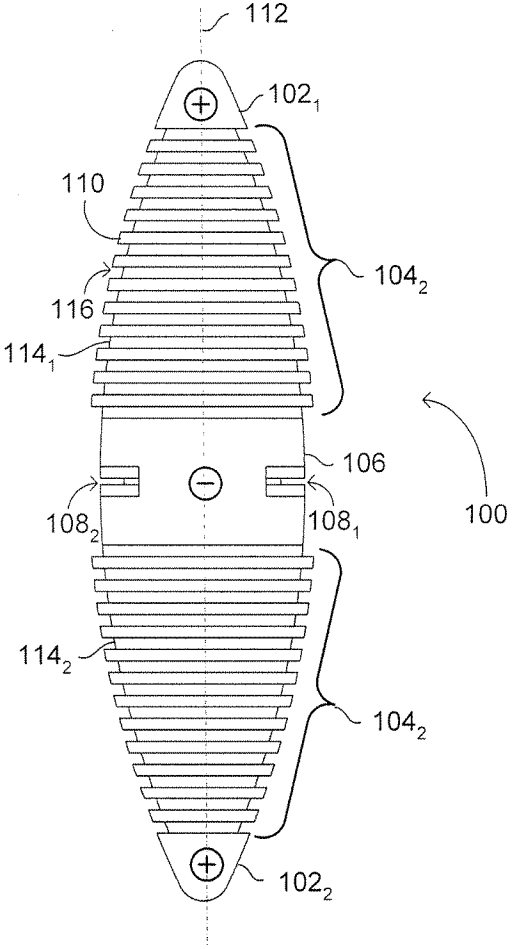

Reference is now made to FIGS. 1A and 1B, which are schematic illustrations of a flexible building segment, generally referenced 100, constructed and operative in accordance with an embodiment of the disclosed technique. FIG. 1A depicts a top view of flexible building segment 100 while FIG. 1B depicts a side view of flexible building segment 100.

Flexible building segment 100 exhibits an elongated oval shape but exhibit other elongated shapes such as a rectangular. Flexible building segment 100 includes five sections, two outer sections, outer section $\mathbf{102}_1$ and outer section $\mathbf{102}_2$, a central section 106 and two ribs section $\mathbf{104}_1$ and $\mathbf{104}_2$. Each of first rib section $\mathbf{104}_1$ and second rib section $\mathbf{104}_2$ includes a respective first flexible portion $\mathbf{114}_1$ and second flexible portion $\mathbf{114}_2$. First flexible portion $\mathbf{114}_1$ couples central section 106 with first outer section $\mathbf{102}_1$ and second flexible portion $\mathbf{114}_2$ couples central section 106 with first outer section $\mathbf{102}_2$.

Each of first ribs section $\mathbf{104}_1$ and second ribs section $\mathbf{104}_2$ includes parallel ribs such as ribs 110. The ribs are perpendicular to the major axis 112 of flexible building segment 100. The ribs in first ribs section $\mathbf{104}_1$ are attached to a respective first flexible portion $\mathbf{114}_1$ and the ribs in second ribs section $\mathbf{104}_2$ are attached to a respective second flexible portion $\mathbf{114}_2$. Furthermore, The width of the ribs is wider than the width of the first flexible portions $\mathbf{114}_1$ and second flexible portion $\mathbf{114}_2$, thus forming ribs attachment slots such as rib attachment slot 116. Central section 106 includes at least two central attachment slots $\mathbf{108}_1$ and $\mathbf{108}_2$ at opposite sides thereof. Each one of first outer section $\mathbf{102}_1$, second outer section $\mathbf{102}_2$ and central section 106 includes a magnet embedded therein. The magnets in first outer section $\mathbf{102}_1$ and second outer section $\mathbf{102}_2$ exhibit the same magnetic alignment while the magnet in central section 106 exhibit an opposite magnetic alignment. These magnets, along with first flexible portions $\mathbf{114}_1$ and second flexible portion $\mathbf{114}_2$ enable each of first outer section $\mathbf{102}_1$ and second outer section $\mathbf{102}_2$ to be folder onto central section 106 and magnetically couple therewith. Furthermore, the magnets embedded in first outer section $\mathbf{102}_1$, second outer section $\mathbf{102}_2$ and central section 106, along with central attachment slots $\mathbf{108}_1$ and $\mathbf{108}_2$ and the rib attachment slots enable flexible building segment 100 to mechanically or magnetically couple with other flexible building segments.

Figure 2A:
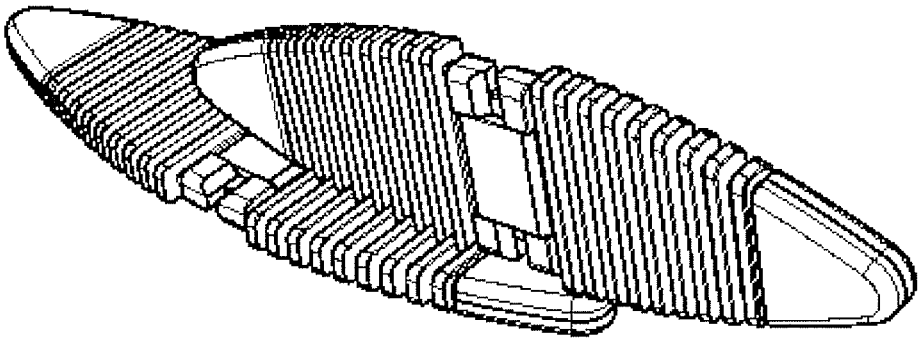
FIGS. 2A-2G are schematic illustration of flexible building segments coupled with each other in various ways.
Figure 2B:
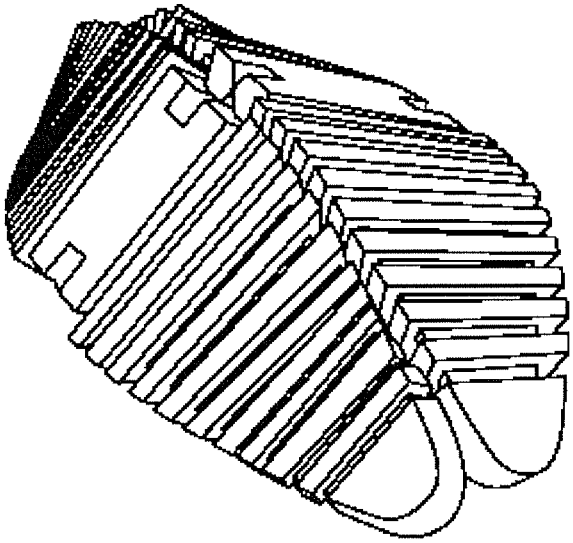
Figure 2C:
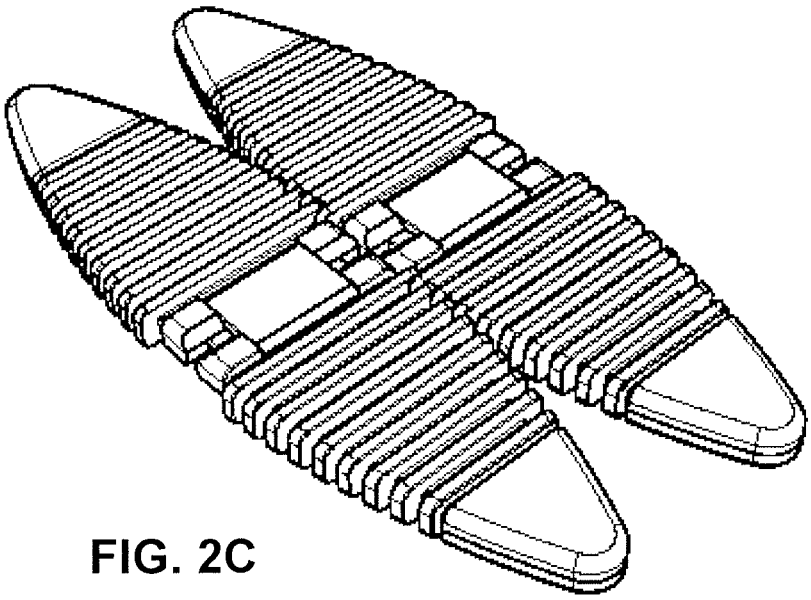
Figure 2D:
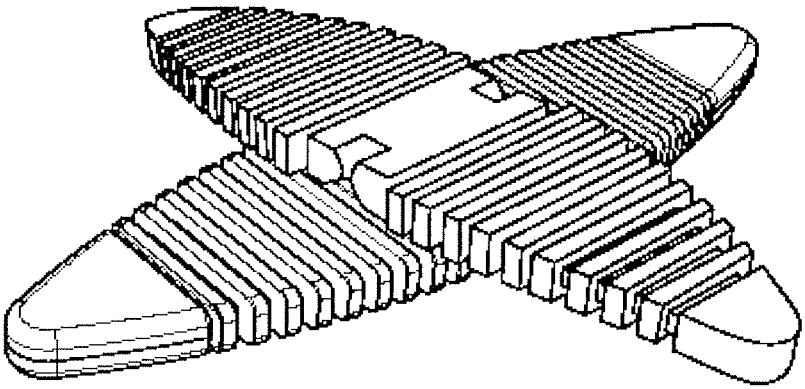
Figure 2E:
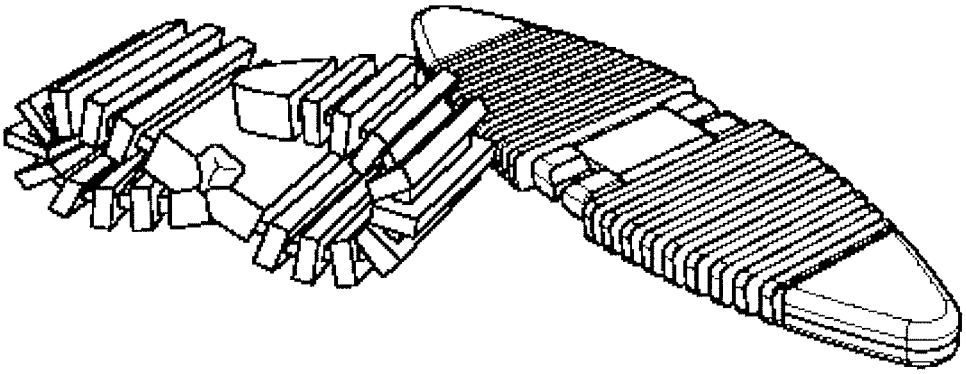
Figure 2F:
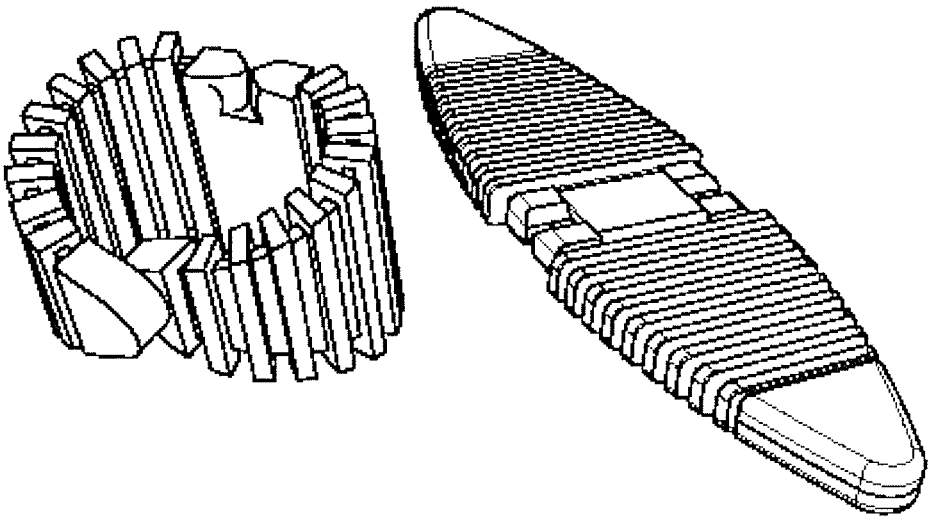
Figure 2G:
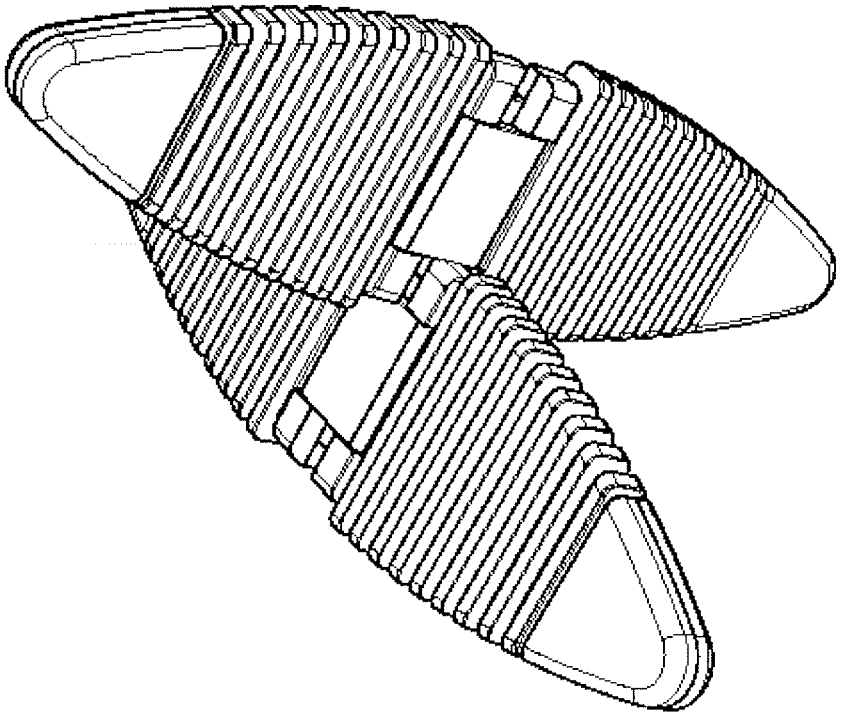

Reference is now made to FIGS. 2A-2G which are schematic illustration of flexible building segments coupled with each other in various ways, in accordance with another embodiment of the disclosed technique. FIGS. 2A-2C depicts two flexible building segments mechanically coupled with each other via the ribs attachments slots. FIG. 2D depicts two flexible building segments magnetically coupled with each other via the magnets in the respective central sections thereof. FIGS. 2E and 2F depicts the outer sections of a flexible building segment magnetically coupled with each other via the respective magnets thereof. FIG. 2G depicts two flexible building segments mechanically coupled with each other via the central attachments slots thereof. By attaching the various sections of flexible building segments to each other and to other flexible building segments, various shapes and forms may be made for various purposes such as game, construction and the like.

Figure 3B:
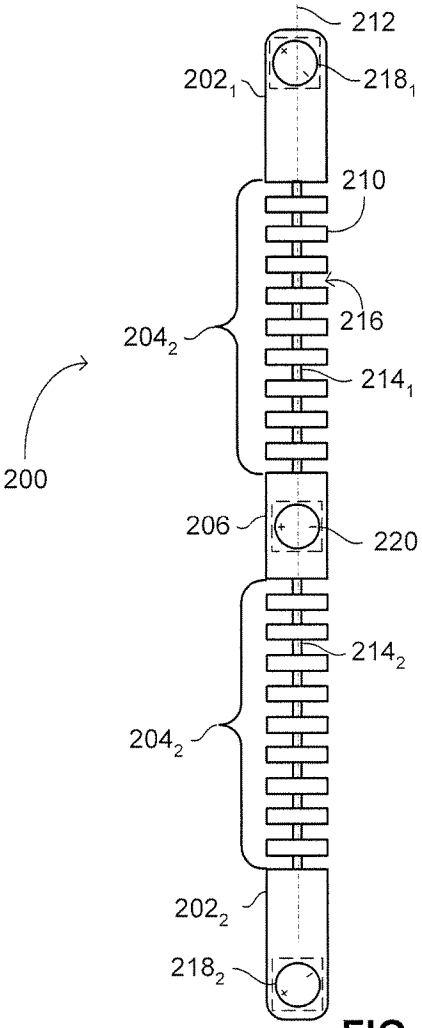
FIGS. 3A-3E are schematic illustrations of a flexible building segment, constructed and operative in accordance with a further embodiment of the disclosed technique.
Figure 3A:
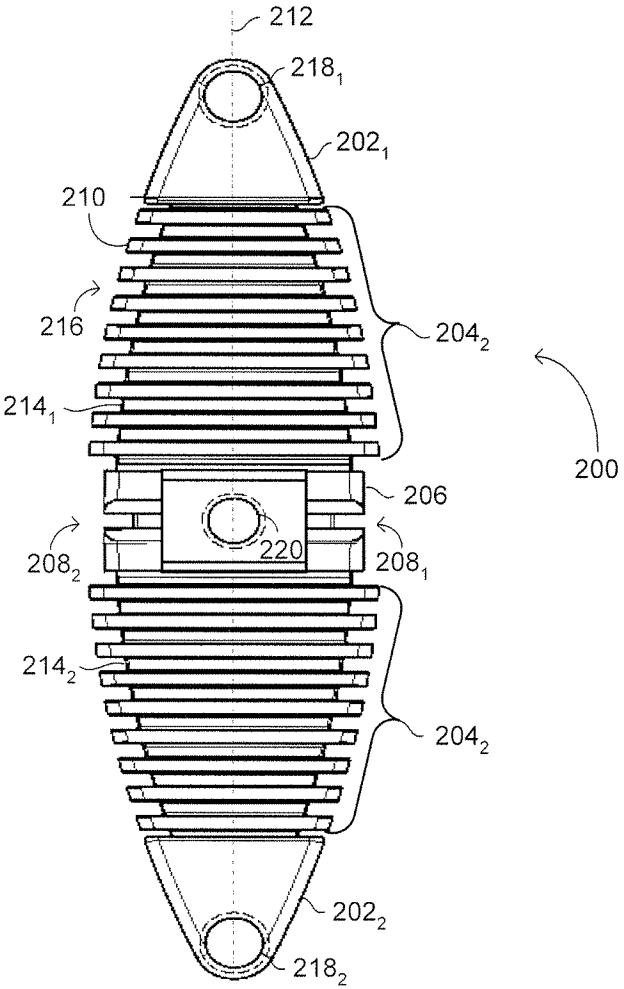
Figure 3E:
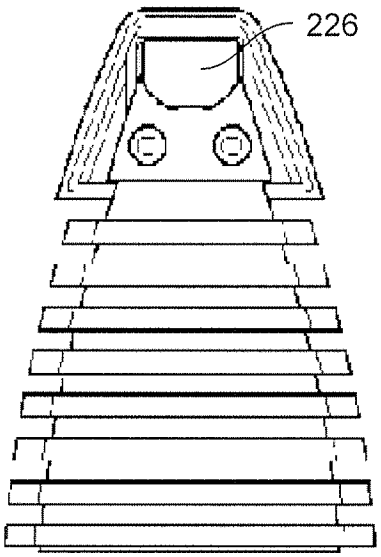

Reference is now made to FIGS. 3A-3E, which are schematic illustrations of a flexible building segment, generally referenced 200, constructed and operative in accordance with a further embodiment of the 30*o* disclosed technique. FIG. 3A depicts a top view of flexible building segment 200 while FIG. 3B depicts a side view of flexible building segment 200. Flexible building segment 200 exhibits an elongated oval shape but exhibit other elongated shapes such as a rectangular. Flexible building segment 200 includes five sections, two outer sections, outer section $\mathbf{202}_1$ and outer section $\mathbf{202}_2$, a central section 206 and two ribs section $\mathbf{204}_1$ and $\mathbf{204}_2$. Each of first rib section $\mathbf{204}_1$ and second rib section $\mathbf{204}_2$ includes a respective first flexible portion $\mathbf{214}_1$ and second flexible portion $\mathbf{214}_2$. First flexible portion $\mathbf{214}_1$ couples central section 206 with first outer section $\mathbf{202}_1$ and second flexible portion $\mathbf{214}_2$ couples central section 206 with first outer section $\mathbf{202}_2$.

Figure 3D:
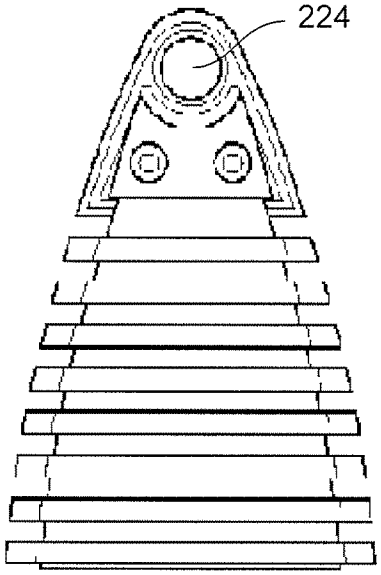
Figure 3C:
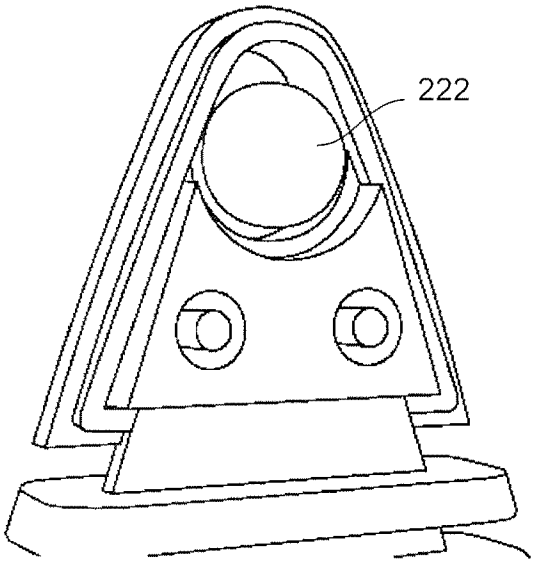

Each of first ribs section $\mathbf{204}_1$ and second ribs section $\mathbf{204}_2$ includes parallel ribs such as ribs 210. The ribs are perpendicular to the major axis 212 of flexible building segment 200. The ribs in first ribs section $\mathbf{204}_1$ are attached to a respective first flexible portion $\mathbf{214}_1$ and the ribs in second ribs section $\mathbf{204}_2$ are attached to a respective second flexible portion $\mathbf{214}_2$. Furthermore, The width of the ribs is wider than the width of the first flexible portions $\mathbf{214}_1$ and second flexible portion $\mathbf{214}_2$, thus forming ribs attachment slots such as rib attachment slot 216. Central section 206 includes at least two central attachment slots $\mathbf{208}_1$ and $\mathbf{208}_2$. Each one of first outer section $\mathbf{202}_1$, second outer section $\mathbf{202}_2$ and central section 206 include a respective rotatable magnet $\mathbf{218}_1$, $\mathbf{218}_2$ and 226 embedded therein. Rotatable magnets $\mathbf{218}_1$ $\mathbf{218}_2$ and 220 are, for example, in the shape of a sphere and are located, in respective cavities such that each may freely rotate and align the magnetic polarity thereof with other magnets (e.g., of other similar flexible building segments). Alternatively, rotatable magnets $\mathbf{218}_1$ $\mathbf{218}_2$ and 220 may be in the form of cylindrical magnets. Each cylindrical magnet rotates about the longitudinal axis thereof (e.g., about a hinge). FIG. 3C and FIG. 3D each depicts an alternative for embedding a sphere rotatable magnet 222 and 224 in flexible building segment 200 while FIG. 3D depicts a cylindrical magnet 226 embedded in flexible building segment 200. In FIG. 3D, the shape of the cavity in which the spherical magnet is located matches the shape sphere magnet 224, such that the magnet is located close to the edge of the casing and thus, have a stronger attraction to the neighboring magnets. Rotatable magnets $\mathbf{218}_1$ $\mathbf{218}_2$ and 220, along with first flexible portions $\mathbf{214}_1$ and second flexible portion $\mathbf{214}_2$ enable each of first outer section $\mathbf{202}_1$ and second outer section $\mathbf{202}_2$ to be folded onto central section 206 and magnetically couple therewith. Furthermore, magnets $\mathbf{218}_1$ $\mathbf{218}_2$ and 220, along with central attachment slots $\mathbf{208}_1$ and $\mathbf{208}_2$ and the rib attachment slots enable flexible building segment 200 to mechanically or magnetically couple with other flexible building segments.

Figure 4A:
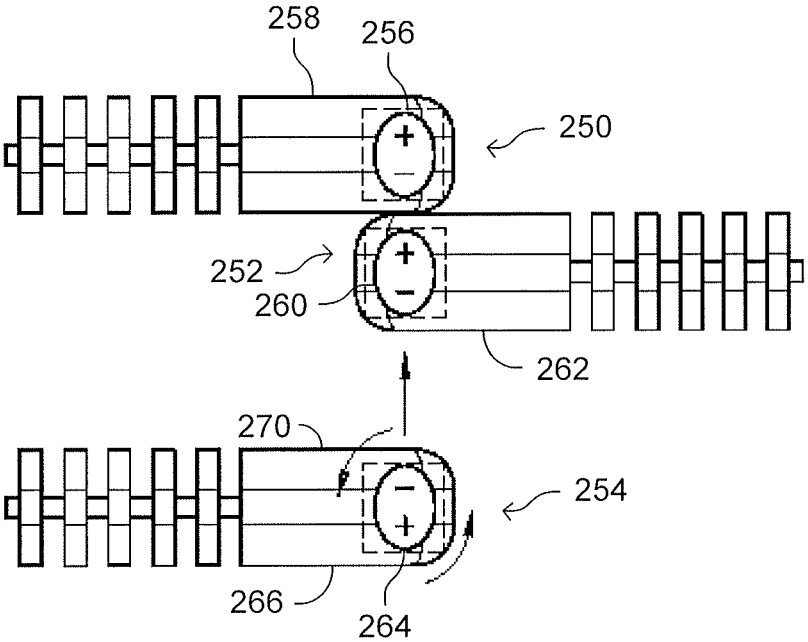
FIGS. 4A and 4B are schematic illustration of three flexible building segments, which are to be magnetically coupled together via the respective rotatable magnets at the outer sections thereof, in accordance with another embodiment of the disclosed technique.
Figure 4B:
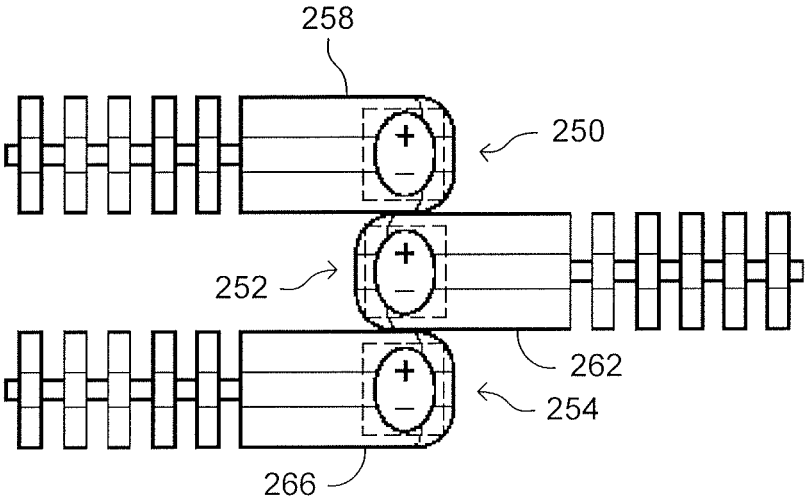

Reference is now made to FIGS. 4A and 4B which are schematic illustration of three flexible building segments, generally referenced 250, 252 and 254, which are to be magnetically coupled together via the respective rotatable magnets at the outer sections thereof, in accordance with another embodiment of the disclosed technique. With reference to FIG. 4A, flexible building segment 250 is magnetically coupled with flexible building segment 252. The south pole of the rotatable magnet 256 at the outer section 258 of flexible building segment 250 is coupled with the north pole of the rotatable magnet 260 at the outer section 262 of flexible building segment 252. Flexible building segment 254 is to be magnetically coupled with flexible building segment 252. However, the south pole of the rotatable magnet 264 of outer section 266 faces the south pole of the rotatable magnet 260. However, rotatable magnet 264 shall rotate as indicated by arrows 268 and 270 such that the north pole thereof shall face the south pole of rotatable magnet 260 and flexible building segment 254 can be magnetically coupled with flexible building segment 252. With reference to FIG. 4B, flexible building segments 250, 252 and 254 are magnetically coupled with each other at 30*o* the respective outer sections 258, 262 and 266 thereof.

Figure 5A:
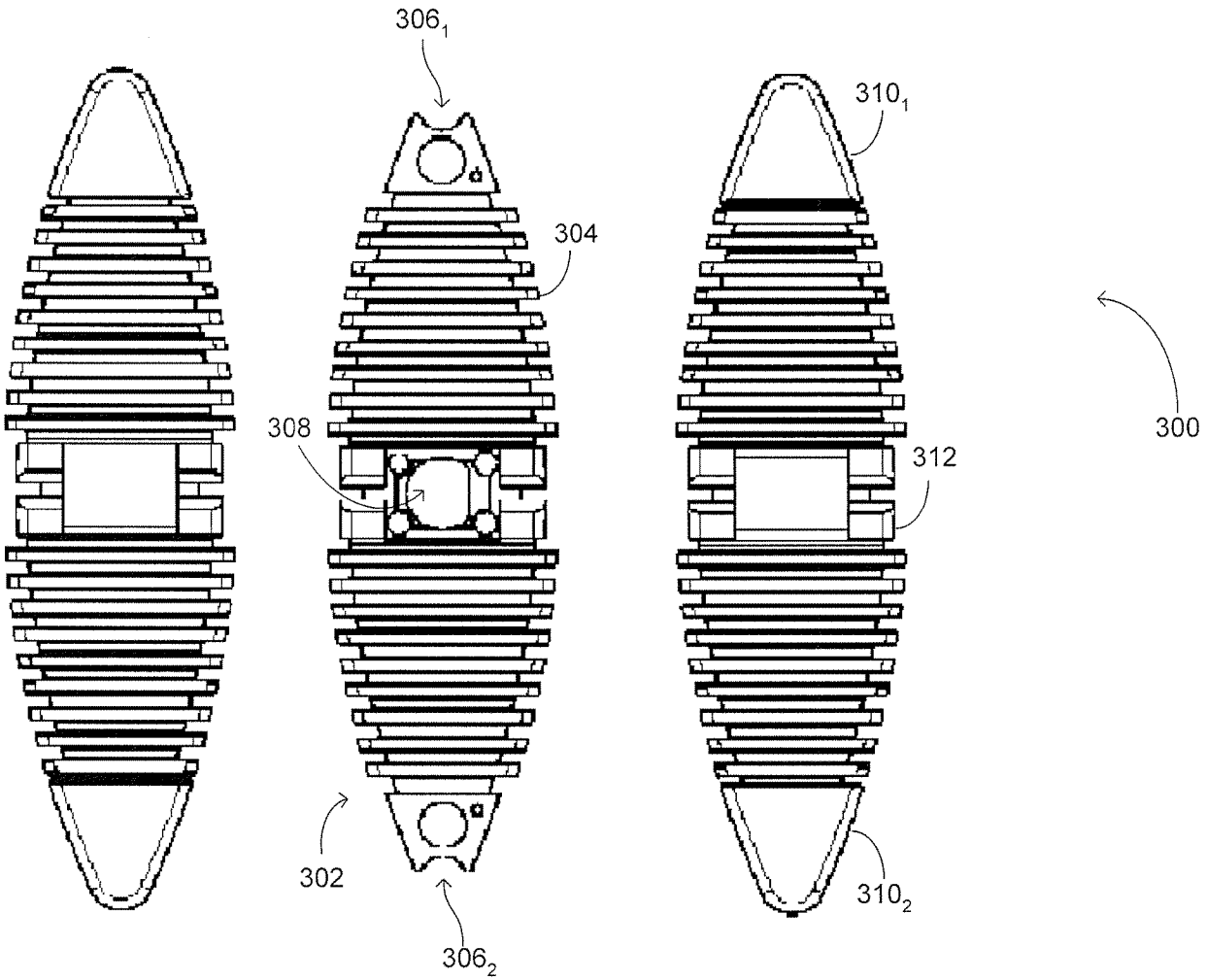
FIGS. 5A-5D are schematic illustrations of a flexible building segment, constructed in accordance with a further embodiment of the disclosed technique.
Figure 5D:
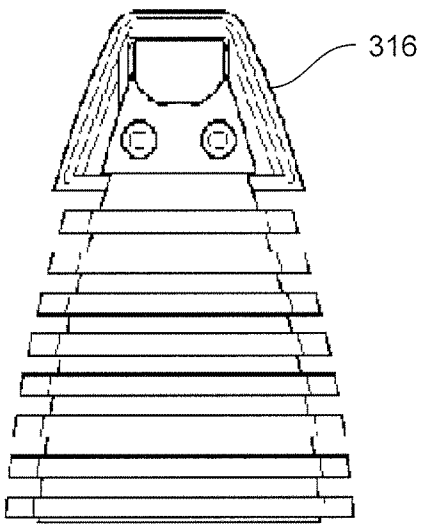
Figure 5C:
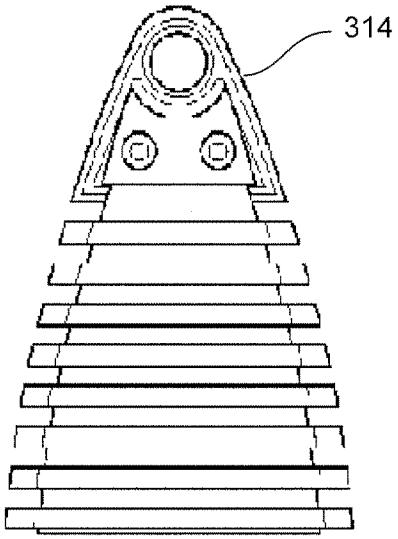
Figure 5B:
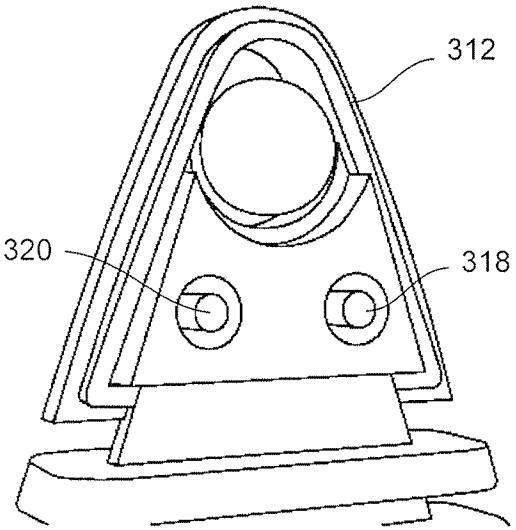

Reference is now made to FIGS. 5A-5D, which are schematic illustrations of a flexible building segment, generally reference 300, constructed in accordance with a further embodiment of the disclosed technique. FIG. 5A depicts an exemplary manner by which a flexible building segment according to the disclosed technique may be constructed. Flexible building segment 500 is constructed from a flexible inner part 302 which includes ribs such as rib 304, two outer sections $\mathbf{306}_1$ and $\mathbf{306}_2$ and a central section 308. Each of outer sections $\mathbf{306}_1$ and $\mathbf{306}_2$ and central section 308 includes a groove in which the magnets (i.e., either rotatable magnets or stationary magnets) are inserted. After the magnets are inserted, outer sections $\mathbf{306}_1$ and $\mathbf{306}_2$ and central section 308 are covered with caps such as end caps $\mathbf{310}_1$, $\mathbf{310}_2$ and central cap 312. With reference to FIGS. 5B-5D, depicted therein are three parts 312, 314 and 316 of caps. Similar parts (not shown) are place over parts 312, 314 and 316 and attached to parts 312, 314 and 316, for example via pins 318 and 320, which may be welded (e.g., sonically) to each other.

It will be appreciated by persons skilled in the art that the disclosed technique is not limited to what has been particularly shown and described hereinabove. Rather the scope of the disclosed technique is defined only by the claims, which follow.

The invention claimed is:

1. A flexible building segment comprising:

a first outer section including a first magnet embedded therein;

a second outer section including a second magnet embedded therein;

a central section including a central magnet embedded therein, said central section further including at least two central attachment slots at opposite sides thereof;

a first ribs section, including a first flexible portion and respective ribs, said first flexible portion coupling said central section with said first outer section, said ribs respective of said first ribs section being attached to said first flexible portion and parallel to each other; and a second ribs section, including a second flexible portion and respective ribs, said first flexible portion coupling said central section with said second outer section, said ribs respective of said second ribs section being attached to said second flexible portion and parallel to each other.

2. The flexible building segment according to claim 1, wherein, said first magnet and said second magnet exhibit a first magnetic alignment and said central magnet exhibiting a magnetic alignment opposite to said first magnetic alignment of said first and said second magnets.

3. The flexible building segment according to claim 2, wherein at least said first magnet and said second magnet are rotating magnets.

4. The flexible building segment according to claim 3, wherein said first magnet and said second magnet exhibit the shape of a sphere, rotating within a cavity.

5. The flexible building segment according to claim 3, wherein said first magnet and said second magnet exhibit the shape of a cylinder, rotating within a cavity.

6. The flexible building segment according to claim 2, wherein at least central magnet is a rotating magnet.

7. The flexible building segment according to claim 6, wherein said central magnet exhibits the shape of a sphere, rotating within a cavity.

8. The flexible building segment according to claim 7, wherein said central magnet exhibits the shape of a cylinder, rotating within a cavity.

9. The flexible building segment according to claim 1, wherein each of said first magnet, said second magnet and said central magnet is operative to be magnetically coupled with another one of said each of said first magnet, said second magnet and said central magnet.

10. The flexible building segment according to claim 1, wherein said flexible building segments is operative to be attached to another similar flexible building segment at the ribs thereof, at the slots thereof or via magnetic coupling between the magnets thereof.

11. The flexible building segment according to claim 1, wherein said flexible building segments is operative to be magnetically coupled with another similar flexible building segment by any of the respective first magnet, second magnet and center magnet.

* * * * *